US006554721B1

(12) United States Patent
Woodward et al.

(10) Patent No.: US 6,554,721 B1
(45) **Date of Patent: *Apr. 29, 2003**

(54) GOLF CLUB HEAD

(75) Inventors: Jay Woodward, Rancho Santa Fe, CA (US); Robert Bottema, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/595,806

(22) Filed: Jun. 16, 2000

Related U.S. Application Data

(63) Continuation of application No. 09/035,277, filed on Mar. 9, 1998, now Pat. No. 6,089,993, which is a continuation-in-part of application No. 08/984,466, filed on Dec. 3, 1997, now abandoned, which is a continuation-in-part of application No. 08/811,699, filed on Mar. 5, 1997, now abandoned.

(60) Provisional application No. 60/013,012, filed on Mar. 7, 1996.

(51) Int. Cl.[7] ..... A63B 53/04

(52) U.S. Cl. ..... 473/331; 473/340; 473/349

(58) Field of Search ..... 473/324, 330, 473/331, 342, 378, 340, 351, 349; D21/733–752

(56) References Cited

U.S. PATENT DOCUMENTS

| | | | | |
|---|---|---|---|---|
| 732,136 A | | 6/1903 | Taylor | |
| 1,094,599 A | | 4/1914 | Samson | |
| 1,289,553 A | | 12/1918 | Sanders | |
| 1,337,958 A | | 4/1920 | Reach | |
| D63,284 S | | 11/1923 | Challis | |
| 1,524,731 A | | 2/1925 | Davis | |
| 1,526,951 A | | 2/1925 | Beaumont | |
| 1,532,545 A | | 4/1925 | Pedersen | |
| 1,535,670 A | | 4/1925 | Davis | |
| 1,968,626 A | | 7/1934 | Young | |
| 2,429,351 A | | 10/1947 | Fetterolf | |
| 3,211,456 A | | 10/1965 | Hyden | |
| 3,869,123 A | | 3/1975 | Thompson | |
| 4,156,526 A | | 5/1979 | Huggins et al. | |
| 4,413,825 A | | 11/1983 | Sasse | |
| 4,422,638 A | | 12/1983 | Tucker | |
| 4,508,349 A | | 4/1985 | Gabauer et al. | |
| 4,529,203 A | * | 7/1985 | Ribaudo | 273/173 |
| 4,679,792 A | | 7/1987 | Straza et al. | |
| 4,964,641 A | | 10/1990 | Miesch et al. | |
| 5,083,778 A | * | 1/1992 | Douglass | 273/78 |
| 5,332,214 A | | 7/1994 | Tucker, Sr. | |
| 5,407,196 A | | 4/1995 | Busnardo | |

(List continued on next page.)

FOREIGN PATENT DOCUMENTS

| | | |
|---|---|---|
| GB | 4301 | 11/1912 |
| JP | 55-34835 | 3/1980 |
| JP | (U) S60-47564 | 4/1985 |
| JP | 3-23877 A | 1/1991 |
| JP | (U) H4-47468 | 4/1992 |

OTHER PUBLICATIONS

The Clubmaker's Art. Pgs. Cover, 1, 176, 193, & 237. 1997.

Golf World. Pgs. Cover, 2, 6, & 41. Mar. 27, 1998.

*Primary Examiner*—Sebastiano Passaniti

(74) *Attorney, Agent, or Firm*—Knobbe, Martens, Olson, & Bear, LLP.

(57) ABSTRACT

A golf club head comprises a main body that defines a front face. The front face includes a plurality of projections extending from the front face. The ends of the projections define a plurality of individual contact surfaces for striking a golf ball. The plurality of projections prevent a golf ball from contacting the front face thereby resulting in a change of the golf ball general contact area. A golf club incorporating the club head provides improved control of a golf ball and also provides improved feel when the club head impacts a golf ball.

4 Claims, 10 Drawing Sheets

U.S. PATENT DOCUMENTS 5,445,386 A 8/1995 Marshall
5,458,332 A 10/1995 Fisher
5,505,450 A 4/1996 Stuff
5,542,675 A 8/1996 Micciche et al.
5,611,742 A * 3/1997 Kobayashi ..... 473/345
5,620,381 A 4/1997 Spalding
5,674,132 A * 10/1997 Fisher ..... 473/290
5,688,190 A 11/1997 Rowland et al.
5,690,562 A 11/1997 Sturm
5,715,290 A 2/1998 Baker et al.
5,766,093 A 6/1998 Rohrer
5,807,190 A 9/1998 Krumme et al.
5,921,871 A 7/1999 Fisher
6,007,434 A * 12/1999 Baker et al. ..... 473/330
6,110,057 A * 8/2000 McKinnon ..... 473/313

* cited by examiner

GOLF CLUB HEAD

The present application is a continuation of: U.S. patent application 09/035,277, filed Mar. 9, 1998, now U.S. Pat. No. 6,089,993 which is a continuation-in-part of: (1) U.S. patent application Ser. No. 08/984,466, filed Dec. 3, 1997, now abandoned, which is a continuation-in-part of U.S. patent application Ser. No. 08/811,699, filed Mar. 5, 1997, now abandoned, which claims priority from U.S. Provisional Patent Application Ser. No. 60/013,012, filed Mar. 7, 1996; and (2) U.S. patent application Ser. No. 08/811,699, filed Mar. 5, 1997, which claims priority from U.S. Provisional Patent Application Ser. No. 60/013,012, filed Mar. 7, 1996.

BACKGROUND OF THE INVENTION

1. Field of the Invention

The invention relates to a golf club head and, more particularly, to a golf club head having a face with projections extending outwardly therefrom for contacting a golf ball.

2. Discussion of the Related Art and Summary of the Invention

The faceplates or front faces of many golf club heads often have striations or other protrusions which extend outward from a base surface of the faceplate. Golf club manufacturers have used the striations or protrusions to delineate the strike area of the club head and to vary the friction between the strike face of the club head and the golf ball and thereby cause the ball to spin at impact.

The Applicant has determined that the use of protrusions on the club strike face may also be used to vary the "feel" of the club by varying the amount of contact area between the club head and the golf ball at impact. The "feel" of the club generally relates to the feeling that the club confers to the player's hands upon impact of the club head with the golf ball. By changing the size and shape of the projections, the amount of contact area between the club head and the golf ball may be reduced or enlarged. In general, it is desirable to configure the protrusions such that the ball only contacts the tips of the protrusions at impact, rather than also contacting the base surface of the protrusions, so that the amount of contact area between the golf ball and the club is not overly increased.

Depending on the particular club type, however, the optimal amount of contact area between the tips of the protrusions and the golf ball may vary. For example, with certain clubs types, such as woods and irons, it is generally desirable to increase the amount of contact area, such as to enhance the level of friction between the club head and the golf ball at impact. This may be accomplished, for example, by using projections that are sized to fit within the golf ball dimples at impact. However, the projections of prior club heads are not configured to enter the dimples of the golf ball and thus are limited in their contact area to the smooth surfaces of the ball. As the dimples cover most of the ball surface, the contact area with such prior art club head faceplates is substantially limited. This limits the striking force on the ball and lessens the driving distance accordingly. Also with the faceplate of the club head only contacting the smooth surfaces of the ball, there is a strong possibility of hitting a slice or hook shot.

On the other hand, the desired amount of contact area between the club face and the golf ball is different for putters than for irons and woods, as putters are used in different environments and with a different swinging style than irons and woods. When putting a golf ball, golfers generally use a pendulum-type motion with a putter head to strike a golf ball with the front face of the putter head and propel the golf ball towards a hole in the green. As the putter head strikes the golf ball, a portion of the front face of the putter head contacts the golf ball for a brief period of time and transfers the momentum of the putter head to the golf ball. The amount of time that the putter head remains in contact with the golf ball during the putting stroke is referred to as the "dwell time."

Golf club manufacturers are attempting to create putters that transfer sufficient momentum to the golf ball while also providing an improved feel for the player. The feel of the putter head is primarily a function of the spring constant (k) of the putter face. The spring constant is generally determined by the Young's modulus of the material, as well as the amount of surface area on the putter face that actually contacts the ball during the putting stroke.

To improve the feel of the putter, golf club manufacturers are providing the putter head with soft plastic inserts that are mounted on the face of the putter head. The plastic inserts are mainly directed toward improving the feel of the putter through the use of low modulus material. U.S. Pat. Nos. 4,928,965 and 5,575,472 are examples of golf putters having soft plastic face inserts. The plastic inserts generally have a low Young's modulus to improve the feel of the putter, but unfortunately also presents certain disadvantages. In particular, plastic inserts have a tendency to lower the sound when the club impacts the ball which causes a lack of audio feedback to the player.

The Applicant has observed that the feel of the putter head may be improved by lowering the spring constant of the putter head. This can be accomplished by lowering the total area of the putter face that contacts the ball during the putting stroke. That is, the "contact area" of the putter face on the golf ball is reduced. Desirably, while the contact area of the putter head is reduced to improve feel, there is still maintained a sufficient amount of contact between the putter face and the golf ball to retain precision and control of the putt. This may be accomplished by manufacturing the putter face with a unique structural design comprising projections that extend outward from the putter face to define a reduced contact area.

In the past, golf club manufacturers have provided projections on the face of golf clubs to impart certain characteristics to the ball upon impact. On the other hand, most of these designs are directed to high impact clubs, such as the irons and woods. For example, Japanese Patent No. 0023877 to Shirayanagi discloses a golf club head having a face plate upon which a plurality of small synthetic resin bumps are formed. The Shirayanagi patent is directed toward a high impact club, rather than a putter. The primary purpose of the face plate is to provide high friction between the ball and the face of the club. Additionally, the inclined orientation of the Shirayanagi face and the bumps on the face promote the transfer of spin to the ball, which is from above a certain level undesirable for a putter. The bumps on the face are also small and resilient so that only a very small deformation of the golf ball causes the ball to wrap around the bumps and contact additional club face. The contact area of the Shirayanagi club is thus not significantly reduced.

British Patent No. 4301 discloses a golf club head for an iron-type club. The head includes hemispherical or conical protuberances which are formed on the club face. The protuberances produce a certain level of roughness to the head upon impact with a golf ball. Unfortunately, this increases the amount of friction between the club face and the ball, which results in ball spin and would lead, if the protuberances were applied to a putter club, to an unpredictable putt.

When projections have been used in connection with putters, the projections unfortunately do not have the proper structure to effectively improve the feel and control of a putter. For example, U.S. Pat. No. 4,964,641 to Miesch et al. discloses a golf club with a machined face. The face of the Miesch club includes a plurality of contiguous pyramidal-shaped elements having sharp tips which collectively form the contact face of the club. However, because the tips of the pyramidal-shaped elements are sharp points, the contact area of the Miesch golf club is extremely small, which causes the ball trajectory to be less controllable. The lack of sufficient contact area may also result in inconsistencies between putting strokes, since the impact of the club upon the ball varies significantly depending upon the location and the angle of the putter face with the ball. Additionally, the sharp ends of the pyramidal structures increase the friction between the club face and the ball, which can result in the club conferring too much spin to the ball so that the golf ball trajectories are unusual and unpredictable. None of the above-described references provides a putter head which improves the feel of the putter at impact while also providing satisfactory levels of control and consistency when putting a golf ball.

Thus, there is a need for a golf club that optimizes the contact area between the strike face and the golf ball at impact. The club desirably has protrusions that are configured to prevent the ball from contacting the base surface of the club face at impact. In the case of woods and irons, the club desirably facilitates the control of the driving action of a golf club and has a faceplate which engages a greater surface area of a golf ball, such as through the use of striker projections which engage the dimples of the club at impact. In the case of a putter, the club head desirably provides improved feel by reducing the amount of contact area at impact, while maintaining a sufficient level of contact area so that control and precision of the putt does not suffer.

The aforementioned needs are satisfied by the present invention. One aspect of the invention relates to a club head comprising a main body defining a strike portion sized to strike a golf ball. The strike portion comprises a main surface and a plurality of projections integrally formed with and extending outward from the main surface. The projections are spaced apart and define individual flat end surfaces for contacting the surface of a golf ball. The flat end surfaces extend along a plane substantially parallel to the main surface, wherein the projections are stiff enough to prevent a golf ball from contacting the main surface when the club head strikes the golf ball.

Desirably, the flat end surfaces collectively define an area that is between 15%–45% of the area of the strike portion. The density of the projections on the strike portion is desirably at least 30 projections per square inch and the projections are desirably uniformly distributed on the strike portion to form a plurality of interlinked hexagonal patterns. In one embodiment, each of the plurality of projections is separated from adjacent other of the plurality of projections by a distance between 0.020 and 0.078 inches.

In one embodiment, the end surfaces of the projections are desirably circular and have a diameter of approximately 0.020–0.078 inches. The projections desirably have a length of at least approximately 0.010 inches and preferably approximately 0.010–0.045 inches. The projections desirably extend in a direction substantially normal to a plane defined by the main surface of the front face. In another embodiment, the end surfaces of the projections each define an elliptical shape or a polygonal shape.

Desirably, the club head defines a lower edge and an upper edge, and the projections are uniformly spaced from the lower edge to the upper edge. The end surfaces of the projections located within a lateral region of the strike portion are desirably larger than the end surfaces of the projections located within a central region of the strike portion.

In another embodiment, the main body further comprise face insert sized to fit within a recess, wherein the projections extend outward from the face insert. The front surface and the projections may be integrally formed of a metallic material.

In another aspect of the invention, there is disclosed a club head comprising a main body defining a front face. Desirably, a plurality of projections extending from the front face, the ends of the projections defining a plurality of individual contact surfaces for striking a golf ball. The plurality of projections prevent a golf ball from contacting the front face thereby resulting in a decrease of the golf ball general contact area.

In yet another aspect of the invention, there is disclosed a club head having projections which are distributed over the striking surface of the faceplate and extend substantially normally from a plane parallel to the striking surface. The distal ends of the projections form a striking surface for driving a golf ball. These projections are of a size which permits them to enter the dimples of the golf ball. Thus, the striking surface includes not only the smooth portions of the ball but also the surface area covered by the dimples. This provides a substantially greater contact surface between the club head and the ball. Further, the striker projections which enter the dimples are frictionally engaged by the dimple walls to make for a straighter shot. In addition, this engagement tends to give the ball spin for a controlled roll. In the case of sand irons, more lift can be attained with differences in the sizes of the projections placed in different positions on the face thereby contributing to more or less loft, as may be desired.

In one embodiment, the striker projections are preferably cylindrical or oval in configuration and preferably are smooth on their tops. The size of the projections are preferably small enough so that they can fit within most ball dimples. For durability the projections are generally made solid but can be made hollow to save weight. The projections are desirably dimensioned and positioned on the faceplate to avoid damage to the ball and to as closely as possible align with ball dimples.

In one embodiment, all of the clubs in a set employ the same basic striker projection design which is directed to make for a solid hit. It has been found that forged irons produce truer online shots with a positive feel on impact. The long irons tend to give straighter shots adding distance while the short irons tend to have greater accuracy. The sand irons are afforded more lift and back spin due to the action of the projections on the dimples. Differences in the size of the projections on different portions of the faceplate can contribute to differences in the amount of loft and spin obtained.

BRIEF DESCRIPTION OF THE DRAWINGS

These and other features of the invention will now be described with reference to the drawings of a preferred embodiment, which are intended to illustrate and not to limit the invention and in which.

DETAILED DESCRIPTION OF THE PREFERRED EMBODIMENT

Figure 1A:
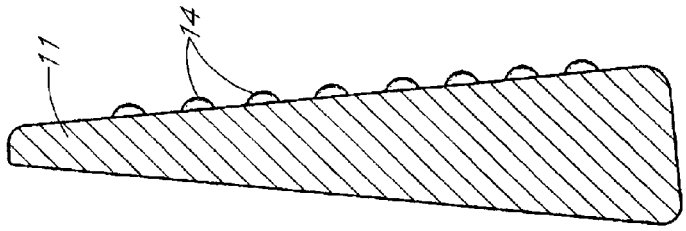
FIG. 1A is a cross-sectional view taken along the plane indicated by 1A—1A in FIG. 1.
Figure 1:
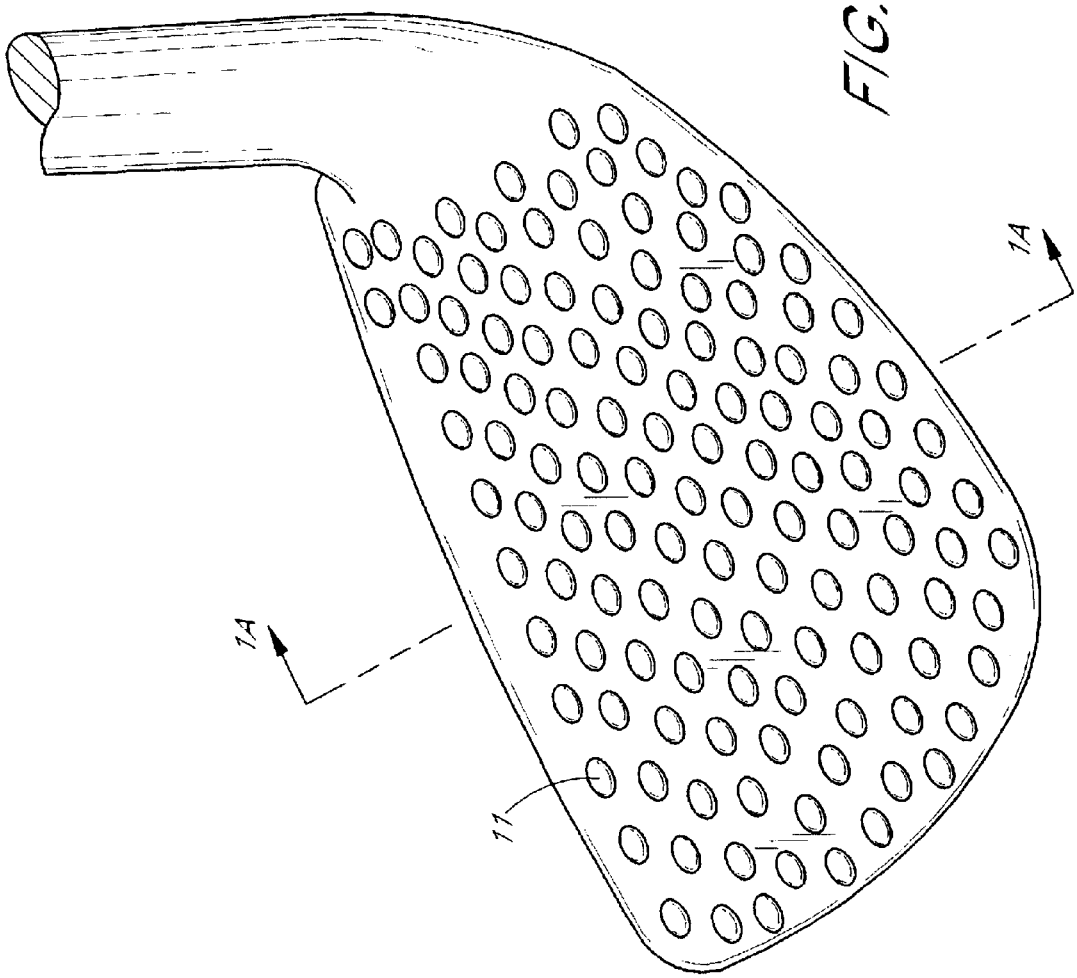
FIG. 1 is a side elevational view of a golf iron incorporating the device of the invention.
Figure 2:
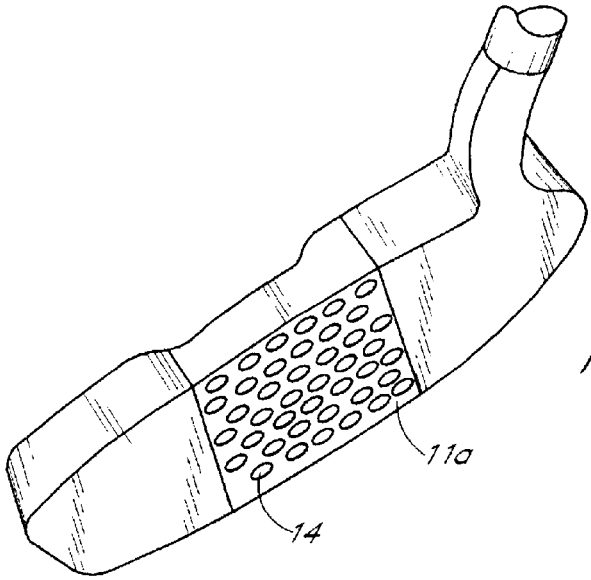
FIG. 2 is a top perspective view of one embodiment of a putter incorporating the device of the invention.
Figure 3:
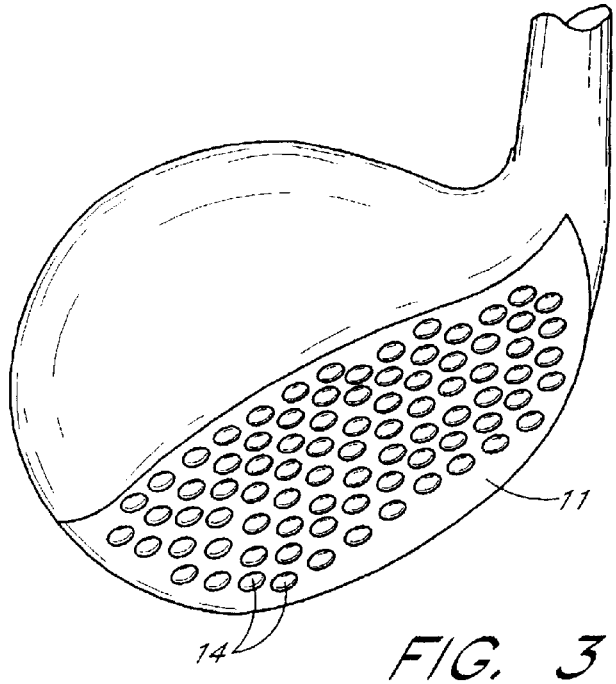
FIG. 3 is a top perspective view of a wood incorporating the device of the invention.
Figure 18:
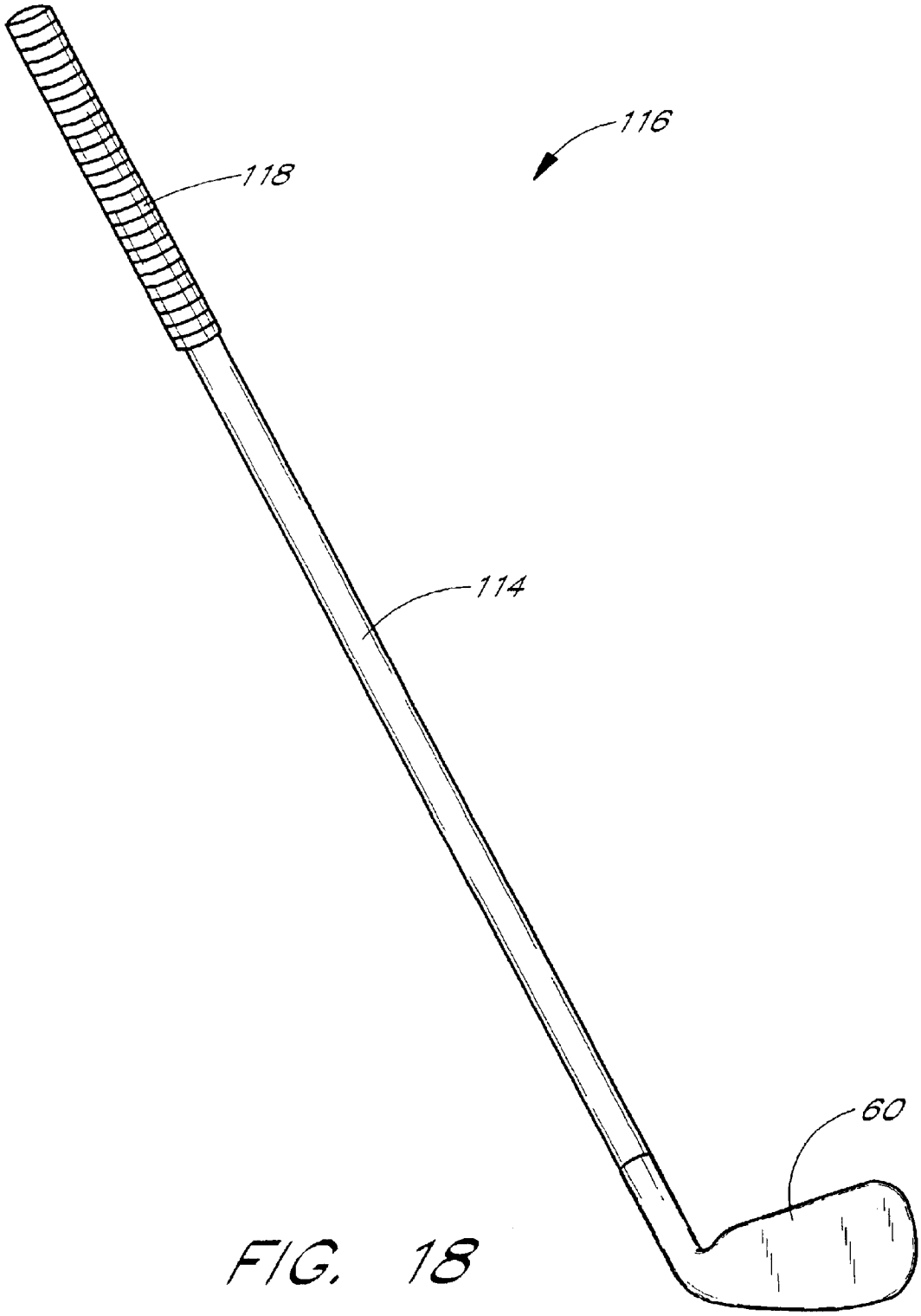
FIG. 18 is a perspective view of a golf club of the present invention.

Referring to FIGS. 1–4, one embodiment of the invention is shown. The device of the invention is shown as incorporated into an iron in FIGS. 1, 1A and 4, in a putter as shown in FIG. 2, and a wood as shown FIG. 3. As will be appreciated by one of skill in the art, one aspect of the invention is incorporating one of any of the embodiments of the golf club heads described herein into a golf club having a shaft and a grip, as shown in FIG. 18.

Figure 4:
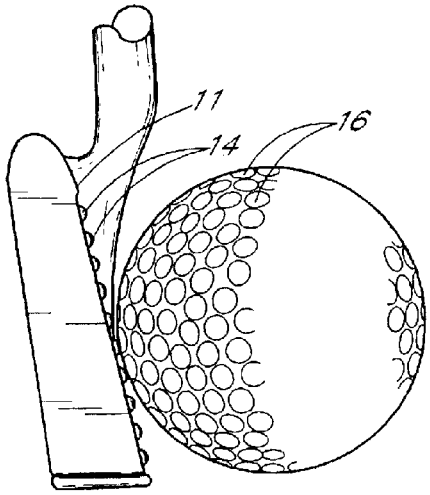
FIG. 4 is a left side elevational view showing a golf iron engaging a golf ball.

A plurality of rigid projections 14 are distributed in a substantially uniform pattern with their distal ends forming the striking surface of each faceplate 11. The striking surface 11A of the putter shown in FIG. 2 is indented. In the case of a wood or an iron, the projections 14 preferably have rounded ends which can fit into the dimples 16 of a golf ball, as shown in FIG. 4. In one embodiment, the projections extend between 0.06 and 0.03 of an inch from the main body of the faceplate and the spacing between adjacent projections is typically 0.14 of an inch. In the embodiments shown in FIGS. 1–4, the projections extend in a direction substantially normal to a plane parallel to the striking surface formed by the projections. The projections may be placed on the surface of the faceplate by forming them in the mold from which the faceplate is forged.

As previously noted, the projections preferably enter into the dimples and provide both a greater contact surface and a frictional engagement with the ball for woods and irons.

Figure 5:
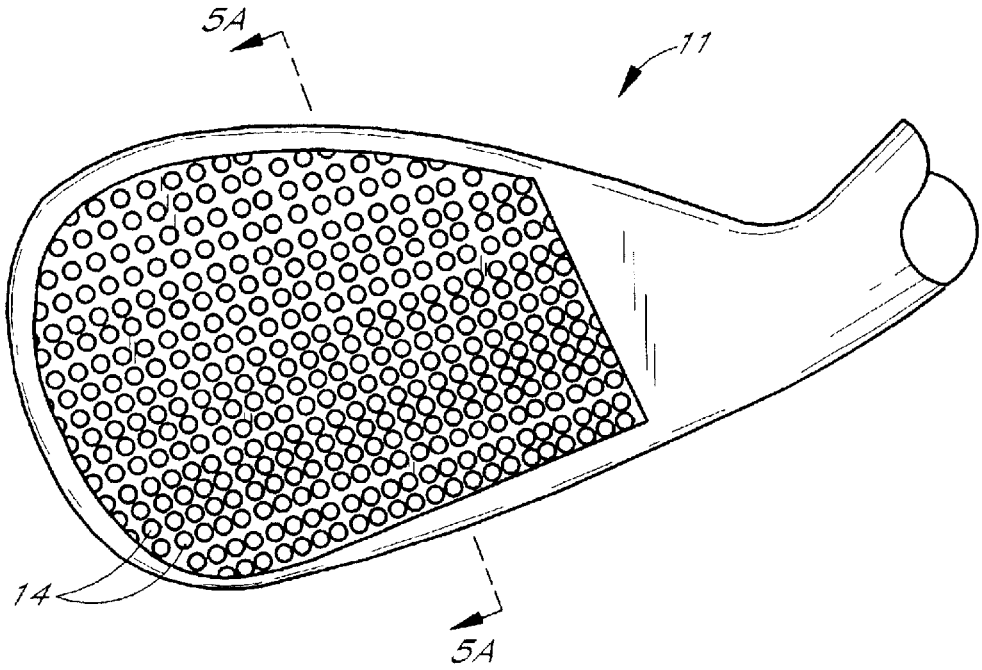
FIG. 5 is a side elevational view illustrating a second embodiment of the invention incorporated in a golf iron.
Figure 5A:
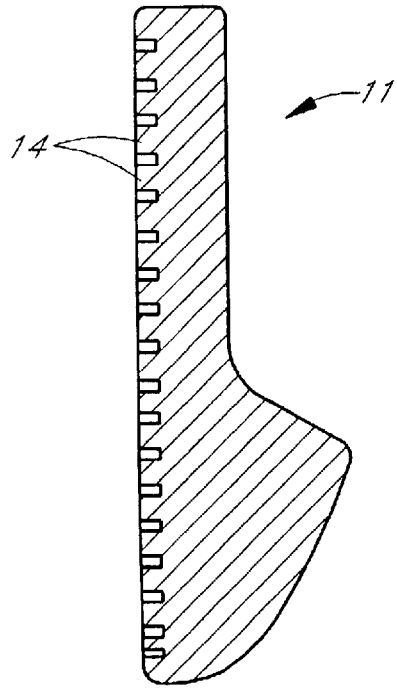
FIG. 5A is a cross-sectional view taken along the plane indicated by 5A—5A in FIG. 5

Referring now to FIGS. 5 and 5A, another embodiment of the invention is shown. This embodiment incorporates the device of the invention into an iron such as a wedge wherein the projections all will fit within the dimples of the golf ball but vary in size going from the top to the bottom of the faceplate. In one embodiment, the projections on the top of the faceplate are about 0.12" in diameter while those at the bottom of the faceplate are about 0.08" in diameter. Preferably, the projections gradually decrease in diameter between these dimensions in going from the top to the bottom of the faceplate.

In one embodiment, the projections extend from the main body of the faceplate between 0.06" for the largest projections and 0.03" for the smallest projections. The space between the projections is preferably 0.14". The projections in this embodiment may be formed in the same manner as for the first embodiment, i.e., by forming them in the mold from which the faceplate is forged. The use of smaller projections near the bottom of the faceplae contributes to greater loft. Back spin is also given the ball which tends to make the ball stop rolling.

Figure 6:
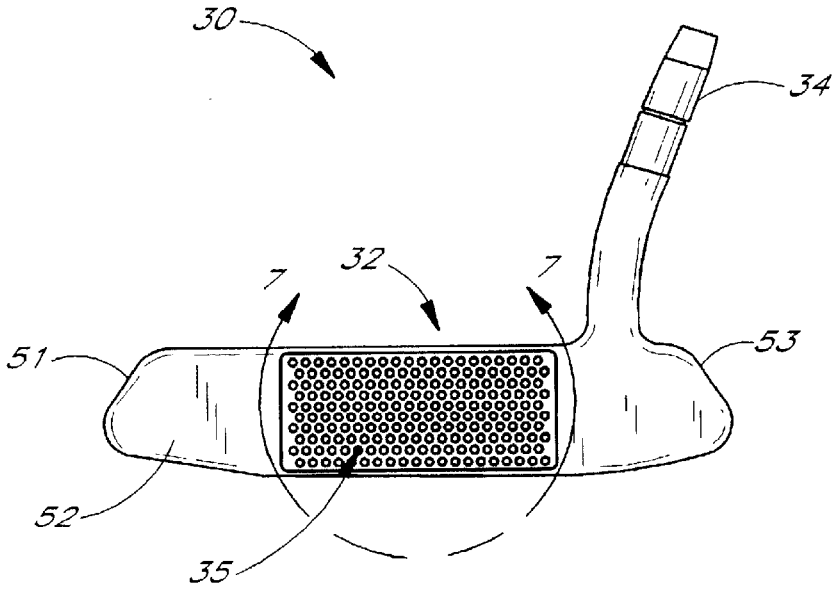
FIG. 6 is a front view of another embodiment of a putter head of the invention.

FIGS. 6–17 show a preferred embodiment of a putter head 30 which is used to putt a golf ball (not shown) toward a hole on a putting green (not shown). FIG. 6 is a front view of the putter head 30 of the present invention. The putter head 30 generally comprises an elongated main body 32 having a neck 34 which extends upwardly from the main body 32. The neck 34 allows the putter head 30 to be connected to a golf club shaft (not shown) in a well known manner.

Figure 7:
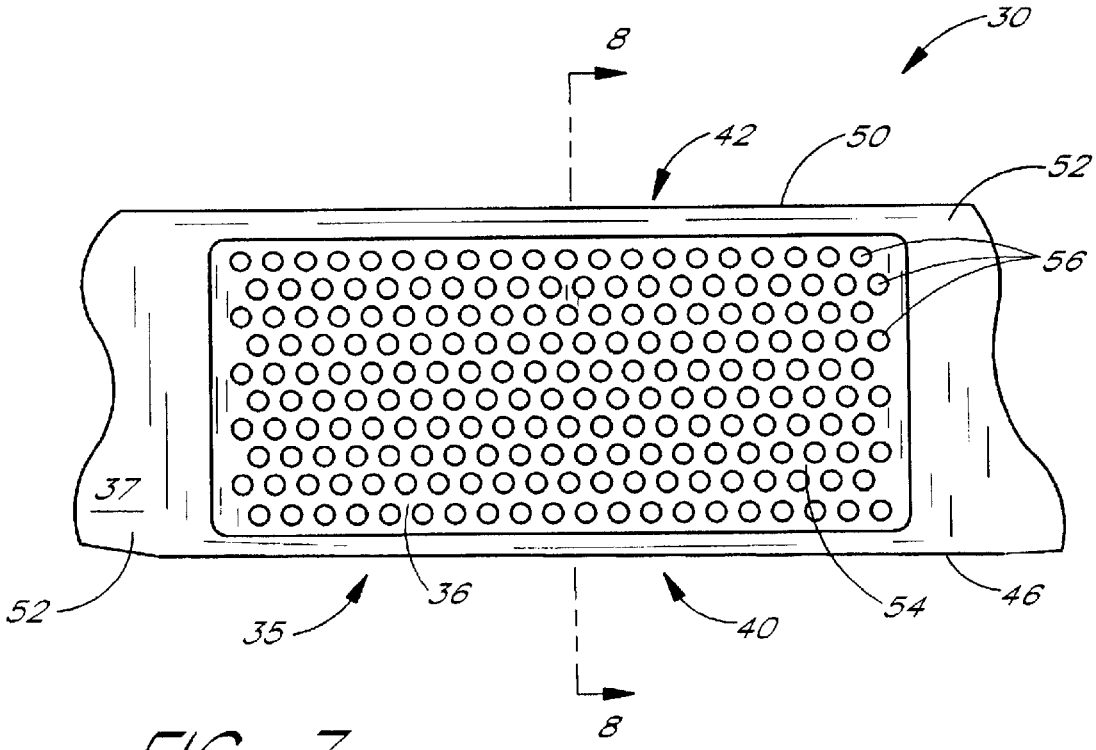
FIG. 7 is an enlarged view of the front face of the putter head of FIG. 6.
Figure 8:
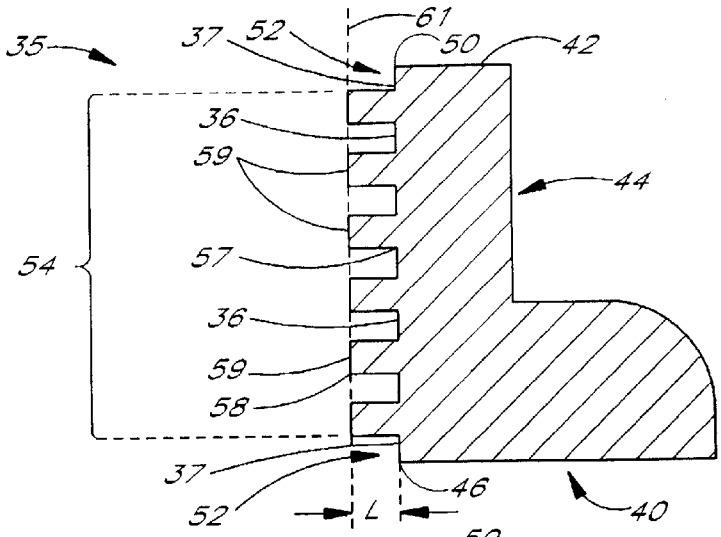
FIG. 8 is a cross-sectional view of the putter head of FIG. 7 taken along line 8—8.

FIG. 7 is an enlarged view of a portion of a front 35 of the putter head 30. FIG. 8 is a cross-sectional side view of the putter head 30 along line 8—8 of FIG. 7. The main body 32 defines a bottom or sole surface 40, a top surface 42 opposed to the bottom surface 40, and a rear surface 44 opposed to the front 35 of the putter head 30. The front 35 of the putter head defines a lower edge 46 and an upper edge 50. The lower edge 46 extends in a substantially horizontal direction and connects the front 35 of the putter head 30 to the sole surface 40. The upper edge 50 extends substantially parallel to the lower edge 46 and connects the front 35 to the top surface 42. The front 35 of the putter head 30 also defines a pair of opposed side edges 51 and 53 (FIG. 6).

With reference to FIG. 7, the front 35 of the putter head 30 is generally divided into a peripheral portion 52 and a strike portion 54. The peripheral portion 52 is bounded by the edges 46, 50, 51, and 53 (FIG. 6) and defines a substantially planar peripheral surface 37. The peripheral portion 52 surrounds the strike portion 54 of the front 35 of the putter head 30. The strike portion 54 is the region of the putter head 30 that is adapted to impact a golf ball during a putt.

The strike portion 54 of the front 35 of the putter head 30 defines a main or front surface 36, from which a plurality of projections 56 extend outwardly, as described more fully below. The strike portion 54 desirably has a shape that conforms to the desired general strike location of a golf ball with the putter head 30, but may also define various other shapes. The strike portion 54 may comprise only a central region of the front 35 of the putter head 30, or alternatively, the strike portion 54 may comprise the entire front 35 of the putter head 30 so that the peripheral portion 52 is either minimized or eliminated. If the putter head 30 has a peripheral portion 52, the strike portion 54 will generally have visual indicia to distinguish itself from the peripheral portion 52, such as a border, recess, or simply the projections 56 themselves.

In the embodiment shown in FIG. 8, the front face 36 of the strike portion 54 is co-planar with the peripheral surface 37 of the peripheral portion 52 the putter head 30. In another embodiment shown in FIG. 9, at least a portion of the front face 36 of the strike portion 54 may be slightly raised with respect to the peripheral surface 37. In yet another embodiment, the front face 36 may be recessed with respect to the peripheral surface 37, as shown in FIG. 10.

As mentioned, the plurality of projections 56 extend outwardly from the front surface 36 defined by the strike portion 54 of the putter head 30. As shown in FIG. 8, the projections 56 each have a first end 57 that is desirably integrally formed with the front face 36, and a second end 58 that is outwardly spaced from the front face 36. Each projection has a length L, defined as the distance between the first end 57 and the second end 58 of the projection 56. The first end 57 of the projection 56 is defined as the location on the projection where the projection 56 joins the front face 36 on at least one side of the projection 56.

The second end 58 of each of the projections 56 defines a substantially flat strike surface or end surface 59. The end surfaces 59 of the projections collectively form the contact or strike face of the putter head 30 when the putter head 30 strikes a golf ball, as described in more detail below. Preferably, the end surfaces 59 collectively define a strike plane 61 that is substantially parallel to the front face 36.

Figure 9:
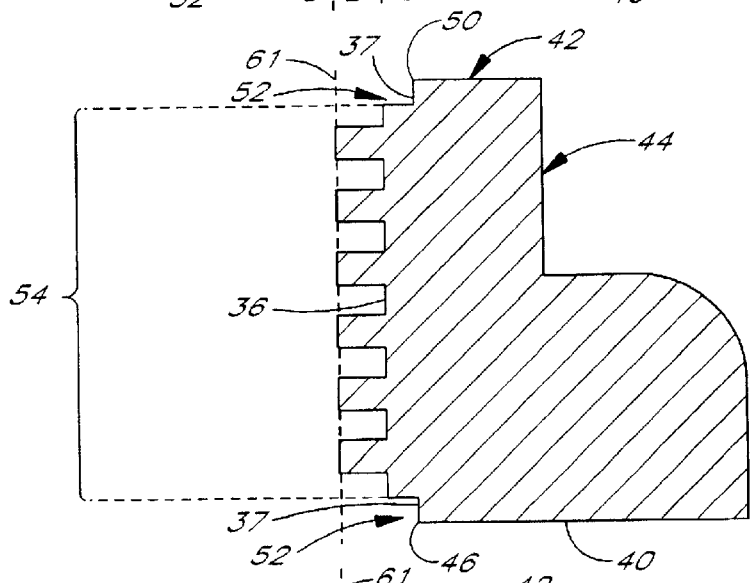
FIG. 9 is a cross-sectional view of another embodiment of a putter head of the invention.
Figure 10:
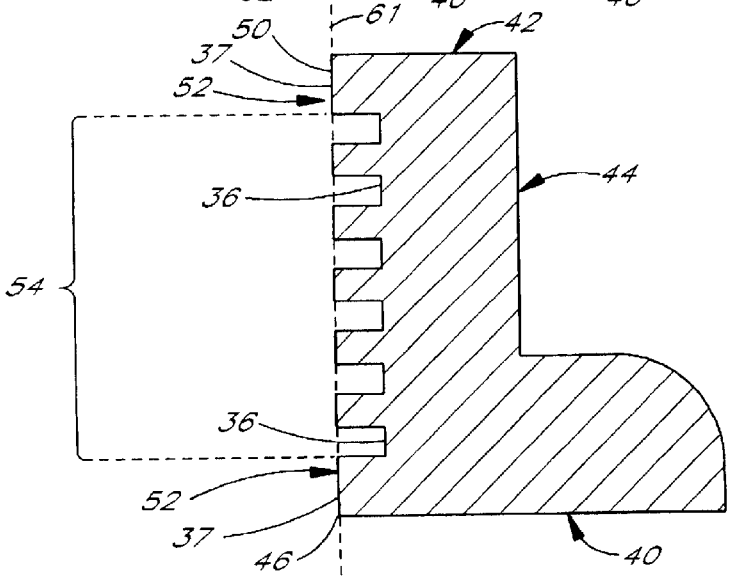
FIG. 10 is a cross-sectional view of yet another embodiment of the putter head of the invention.

In the embodiments shown in FIGS. 8 and 9, the projections 56 extend outwardly so that the end surfaces 59 of the projections 56 are spaced outward with respect to the peripheral surface 37. That is, the strike plane 61 defined by the end surfaces 59 of the projections 56 is spaced outward from a plane defined by the peripheral surface 37. The projections 56 are thus visible looking downward at the putter head 30 from the player's perspective. Alternatively, if the front face 36 is recessed, the length L of the projections 56 may be selected such that the strike plane 61 is co-planar with the peripheral surface 37, as shown in FIG. 10. Accordingly, looking downward toward the putter head 30, the projections 56 will appear hidden from the player perspective so as to be less distracting during a shot.

Figure 11A:
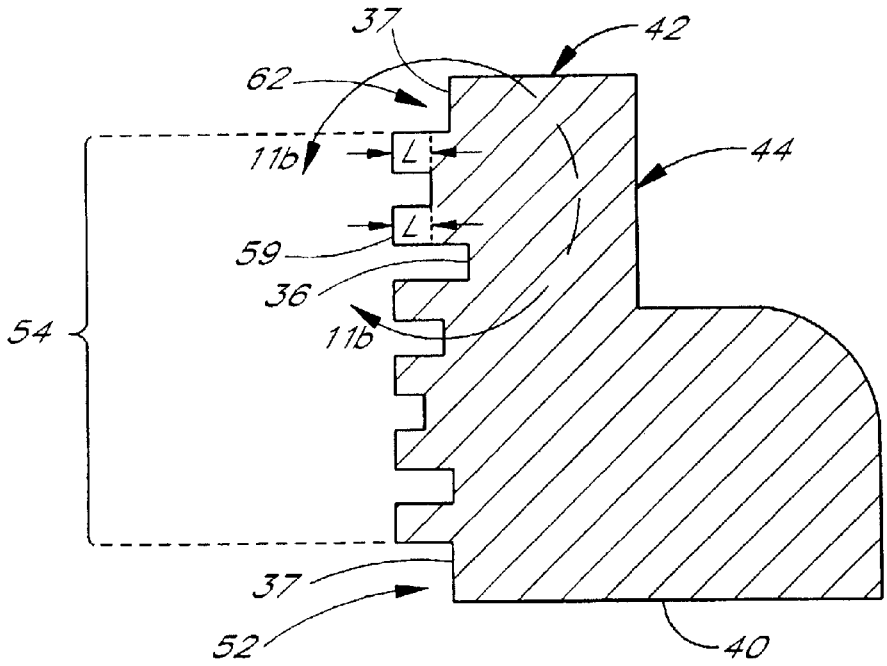
FIG. 11A is a cross-sectional view of another embodiment of a putter head of the invention.
Figure 11B:
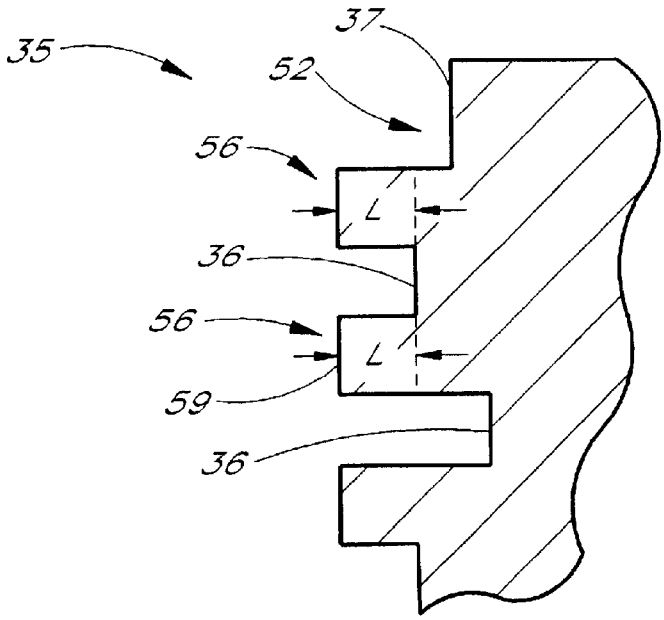
FIG. 11B is an enlarged view of the front face of the putter head of FIG. 11A.

As shown in FIG. 11A, the depth of the front face 36 relative to the end surfaces 59 of the projections 56 may vary across the strike portion 54 so that the entire front face 36 is not coplanar. FIG. 11B is an enlarged view of the front 35 of the putter head 30. As shown, the length L of each projection 56 is equal to the length of the shorter side of the projection 56.

The projections 56 preferably have a length L that is desirably at least approximately 0.010 inches and is preferably between approximately 0.010 and 0.045 inches. As shown in FIG. 7, the projections are preferably spaced uniformly moving from the vicinity of the lower edge 46 of the front face 36 toward the vicinity of the upper edge 50 of the front face 36 so as to eliminate the possibility of a golf ball hitting the lower edge 46. Additionally, the projections 56 are preferably arranged in a predetermined pattern, as described in more detail below.

Figure 12:
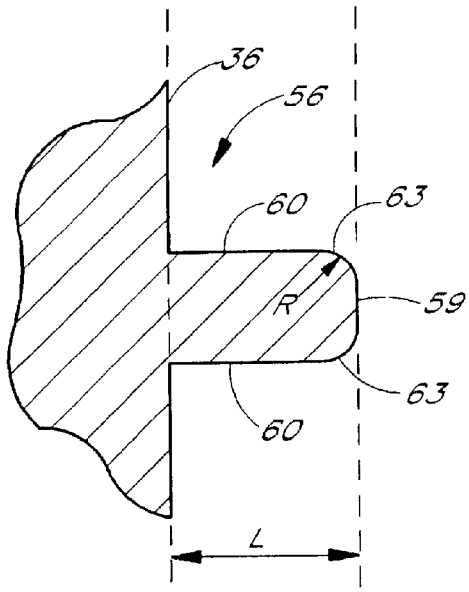
FIG. 12 is an enlarged cross-sectional view of a projection on the putter head of the invention.

FIG. 12 is an enlarged cross-sectional view of one embodiment of a single projection 56. In this embodiment, the projection 56 comprises a cylindrically shaped structure having a substantially uniform thickness moving along the length L. The end surface 59 of the projection 56 is substantially flat and merges with side surfaces 60 of the projection 56 through a rounded connecting surface 63 having a radius R. The rounded connecting surface 63 eliminates a sharp edge between the end surface 59 and the side surfaces 60 of the projection 56. The rounded connecting surfaces 63 may be formed using any of a wide variety of manufacturing methods, such as, for example, sandblasting.

The radius R of the rounded connecting surface 63 is desirably selected to improve the putting characteristics of the putter head 30. For example, the radius R may be selected so that a golf ball that impacts the end surfaces 59 over any of a wide range of impact angles will consistently rebound off the end surfaces 59 in a desired direction. A sharp edge between the end surfaces 59 and the side surfaces 60 of the projections 56 may cause a golf ball to rebound off the putter head 30 at wider angles so that the ball travels widely to the left or right of the desired target. Desirably, the radius R of the rounded connecting surface 63 is at least 0.0001 inches, and preferably between 0.005–0.012 inches.

Figure 13:
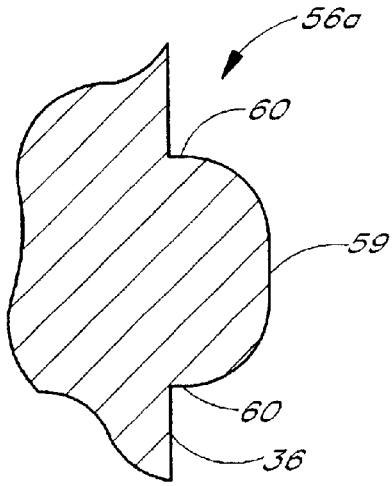
FIG. 13 is an enlarged view of a second embodiment of a projection.
Figure 14:
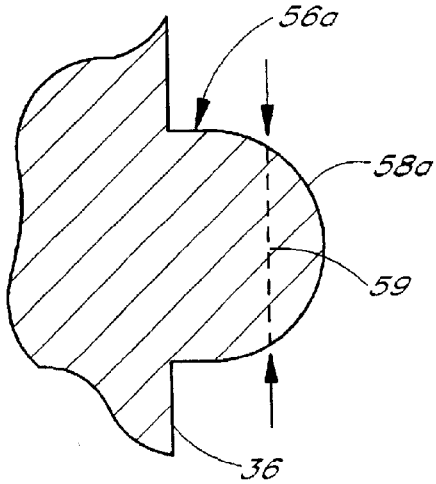
FIG. 14 is an enlarged view of a projection used to form the projection of FIG. 13.

FIG. 13 shows a second embodiment of a projection, referred to as projection 56*a*. In this embodiment, the side surfaces 60 of the projection 56*a* are curved or rounded. The end surface 59 of the projection 56*a* is substantially flat so that the projection 56*a* has a truncated hemispherical shape. With reference to FIG. 14, the projection 56*a* may be formed by first forming a hemispherical-shaped projection 56*a* using a well-known manufacturing method, such as, for example, die casting, injection molding, forging, etc. The projection 56*a* is then subjected to a finishing operation in which the second end 58*a* of the projection 56*a* is ground to form the flat end surface 59, as shown by the dashed line.

The sizes and shapes of the projections 56 may be varied across the front face 36 of the putter head 30. Additionally, the flat end surfaces 59 of the projections 56 may define any of a wide variety of shapes, such as circles, ellipses, or any of a wide variety of polygons, such as, triangles, quadrilaterals, pentagons, hexagons, etc. Preferably, the projections 56 all have the same length L so as to ensure a consistent feel resulting from a symmetrical contacting of the ball by the projection pattern.

Figure 15:
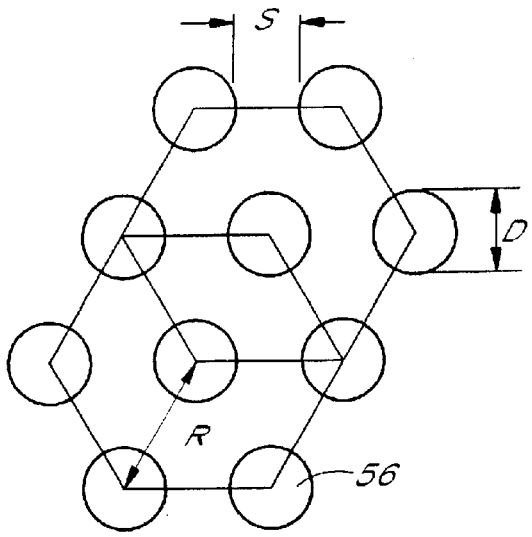
FIG. 15 is an enlarged view of a plurality of projections arranged in a predetermined pattern.

As shown in FIGS. 7 and 15, the projections 56 preferably define a series of predetermined uniform patterns across the front 35 of the putter head 30. FIG. 15 is an enlarged view of a group of projections 56 arranged in a desired pattern. Specifically, the projections 56 collectively form interlinked hexagonal patterns, wherein the hexagons have a radius R. Within each of the hexagonal patterns, the projections 56 are separated by a horizontal distance S, which is preferably between 0.020 and 0.078 inches. Additionally, each projection 56 has a diameter D which is preferably between 0.020 and 0.078 inches. The spacing S is desirably smaller than the size of the dimples on a golf ball to prevent the projections 56 from entering the dimples when the putter head 30 strikes the golf ball.

Desirably, the number of projections 56 within a given area of the front 35 of the putter head 30, or the density n of the projections, is maintained within a certain level. Preferably, the density n of the projections 56 is at least 30 projections per square inch. The density (n) of the projections 56 in the interlinked hexagonal pattern may desirably be calculated by using the following formula:

$$n=(2\times\sqrt{3}/3)\times 1/(S+D)^2)$$

The putter head 30 is used to propel a golf ball toward a hole by striking the golf ball with the strike face that is collectively formed by the end surfaces 59 of the projections 56. Desirably, the end surfaces 59 of the projections are the only portion of the putter head 30 to contact the golf ball during the putting stroke. Because the combined surface area of the end surfaces 59 comprise only a percentage of the area of the entire front 35 of the putter head 30, the total area of the putter head 30 that actually contacts or strikes the golf ball is advantageously reduced. The projections 56 thus improve the feel of the putter head 30 when striking a golf ball. However, although the contact area is reduced, the flat end surfaces 59 of the projections 56 still provide sufficient contact area between the ball and the putter head 30 so that control of the golf ball is not adversely affected.

Preferably, the combined surface area of the flat end surfaces 59 of the projections 56 is between 15 to 45 percent of the surface area of the strike portion 54 of the front face 36. In general, the more the contact area of the putter head 30 is reduced, the lower the spring constant of the front face 36 and the softer the putter head 30 feels upon impact with a golf ball. It has been noticed that the dwell time, or the amount of time that the putter head 30 remains in contact with the ball at impact, tends to increase as the amount of contact surface of the putter head 30 with the ball is reduced. The reason is that the reduction of contact area results in a concentration of stress on the surface of the ball. The concentration of stress causes the ball to deform more upon impact and therefore to stay more in contact with the face. A longer dwell time provides improved control of the golf ball and a more precise putting shot.

In a preferred embodiment, the projections 56 are stiff enough and long enough to prevent a golf ball from contacting the front face 36 when the putter head 30 strikes the golf ball at normal putting speeds. The stiffness, or the resistance to deflection upon impact, of the projections 56 thus contributes to the. improved feel of the putter head 30. Nonetheless, the projections 56 may still have a certain degree of controlled deflection. According to the USGA rules, the hardness of the material constituting the projections should not be lower than 95 shore A.

Figure 16:
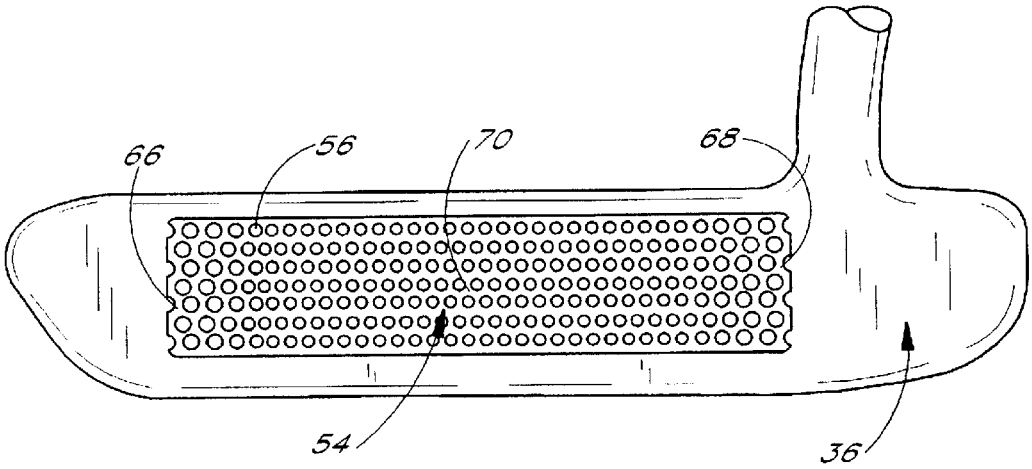
FIG. 16 is another enlarged view of the front face of a putter head.

As shown in FIG. 16, the size or surface area of each of the end surfaces 59 of the projections 56 may be varied across the strike portion 54. For example, at lateral ends 66 and 68 of the strike portion 54, the flat end surfaces 59 of the projections 56 may be larger than the flat end surfaces 59 of the projections 56 located within a central region 70 of the strike portion 54. Such a configuration desirably increases the area of the strike face defined by the end surfaces 59 of the projection 56 located in the lateral ends 66, 68 of the strike portion 54. This design results in an enhanced distribution of energy transference to the golf ball when struck by the putter head 30, even when the putter head 30 is hit off-center, or near the lateral ends 66, 68 of the strike portion 54. This compensates for the loss of energy that typically results from off-centered hits on the front face of prior putter heads. The increased surface area of the end surfaces 59 at the lateral ends 66, 68 provides for a stiffer feel than in the central region 70, where the end surfaces 59 are smaller.

Figure 17:
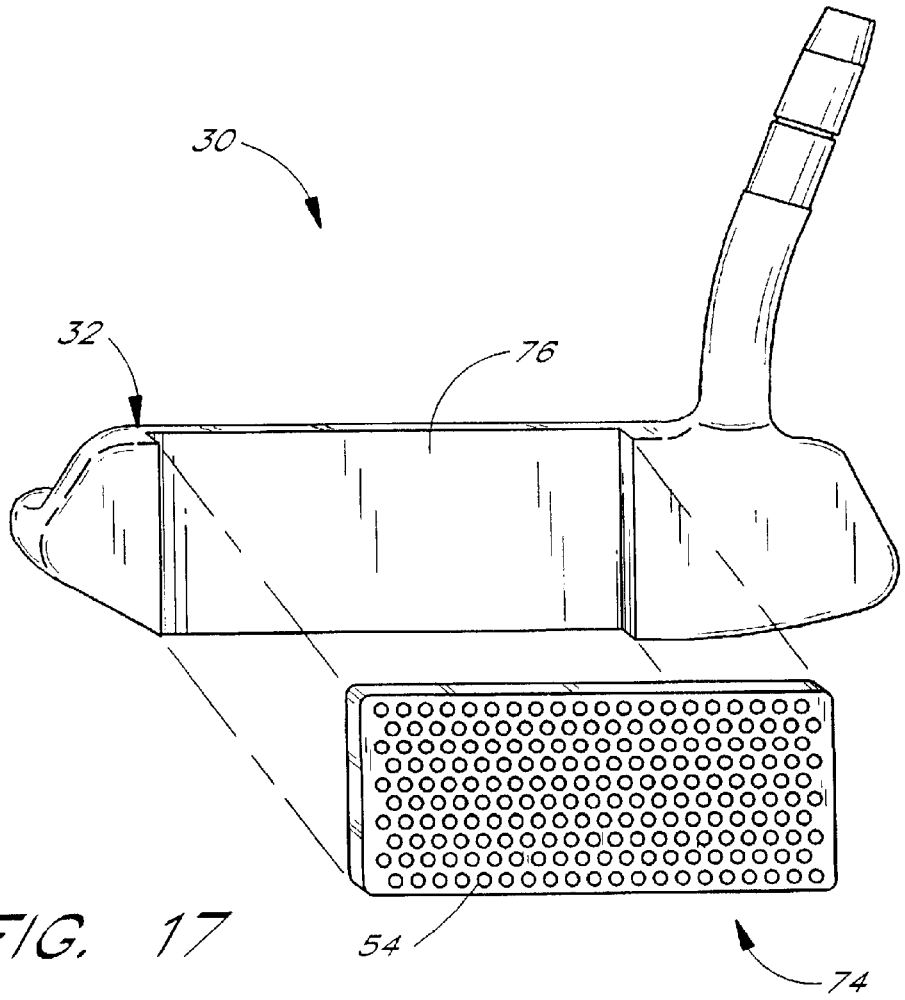
FIG. 17 is a perspective view of another embodiment of the putter head of the present invention including an insert that attaches to the putter head.

FIG. 17 illustrates an alternative embodiment of the putter head 30, which includes a face insert 74 that is sized and shaped to fit within a recess 76 in the front 35 of the elongated body 32. The face insert 74 comprises a plate-like structure that defines the strike portion 54. A plurality of projections 56 extend outwardly from the face insert 74, as described above with respect to the previous embodiment. In use, the face insert 74 is positioned within the recess 76 of the club head 30 and attached thereto. The face insert 74 may be attached to the main body 32 using any suitable means, such as mechanical bonding, adhesive bonding, welding, brazing, etc.

The face insert 74 may advantageously be formed of a material having a lower Young's modulus than the main body 32. The face insert 74 may be formed either from a metallic or from a polymeric material. A metallic material for the face insert 74 provides the putter head 30 with a more solid feel at impact with a golf ball, whereas a polymeric material, such as plastic or rubber, provides a softer feel than a metallic face insert 74. The face insert 74 may be manufactured of the same material as the main body 32 or it may be manufactured of a different material to vary the characteristics of the putter head 30. For example, the face insert 74 may be manufactured of plastic for promoting a soft feel at impact, and the main body 32 may be manufactured of a high density material, such as brass, copper, lead, etc., which provides improved mass distribution.

The putter head 30 of the present invention provides an increase in dwell time and a decrease in the rebound of the putter head 30 at impact with a golf ball. The rebound generally relates to the tendency of the golf ball to bounce off the club head. In an experimental test, performance characteristics of the putter head 30, such as rebound, dwell-time, and acceleration of the golf ball, were measured. The experiment consisted of testing seven putters including (1) a standard NC2 Taylor Made Putter, (2) an Odyssey DF660, (3) a Titleist Cameron putter with a Teryllium insert (copper alloy insert), (4) a Ping Isopur with a urethane insert, (5) a steel putter head 30 of the invention with 20% contact area (with respect to the front surface 36), (6) a steel putter head 30 of the invention with 30% contact area, and (7) a putter head 30 of the invention with 30% contact area and a urethane insert of 95 shore A. Each of the putters were standardized with respect to loft, lie, head mass, shaft length, and swing weight.

The testing method consisted of using a putting pendulum to strike a golf ball, as is known in the art. An accelerometer was attached to each of the putter heads to measure the impact force and dwell time. An indoor artificial putting surface was used primarily for consistency and to eliminate environmental variances. The putting pendulum was calibrated for an approximate 100 inch putt. The distance, peak force, and dwell time were recorded after impact with the putters.

A rebound measurement is typically measured as a percentage with respect to a standard putter. In the current experiment, the NC2 Taylor Made putter was used as the standard putter based on the uniform steel face of the NC2 putter. The rebound was calculated using the following equation:

$$\%\ \text{Rebound}=(\text{distance of ball with putter x})(\text{distance of ball with NC2 putter})\times 100$$

The peak force measurements relate to the maximum force induced into the putter during impact with the golf ball. It is assumed that a higher peak force value results in a greater shock being transferred to the player's hands. For each putter, the measurements were performed 10 times and averages were calculated for more consistency. The results are reported in the following table:

| | REFERENCE | | | | INVENTION | | |
|---|---|---|---|---|---|---|---|
| | (1) | (2) | (3) | (4) | (5) | (6) | (7) |
| Rebound (in.) | 104.5 | 101.0 | 102.9 | 113.9 | 98.6 | 100.5 | 95.0 |
| Dwell Time (in μsec.) | 848 | 874 | 890 | 916 | 956 | 950 | 1139 |
| Peak Accel. (in g) | 0.054 | N/A* | 0.0516 | N/A* | 0.0458 | 0.050 | N/A* |

As shown, the dwell time increases significantly for the putter head 30 of the present invention with respect to the other putters. Additionally, the rebound and peak acceleration both decreased for the putter head 30, which indicates that the putter head 30 provides a user with an improved feel at impact.

The projections 56 of the putter head 30 thus improve the feel of the putter head 30 with respect to prior putters. The reduced contact area provided by the end surfaces 59 of the projections 56 lowers the spring constant of the putter head 30 to provide a softer feel. However, the flat end surfaces 59 still provide sufficient contact area with a golf ball to provide the putter head 30 with control and consistency in putting a golf ball. Additionally, the projections 56 provide the putter head 30 with an increased dwell time and a reduction in rebound and impact force to further improve the feel of the putter head 30.

Although the foregoing description of the invention has shown, described and pointed out fluidamental novel features of the invention, it will be understood that various omissions, substitutions, and changes in the form of the detail of the apparatus and method as illustrated and described, as well as the uses thereof, may be made by those skilled in the art without departing from the spirit of the present invention. Consequently, the scope of the invention should not be limited to the foregoing discussion, but should be defined by the appended claims.

What is claimed is:

1. A putter head comprising a putter head body defining a series of projections, each of the projections defining a substantially flat end surface and, at least in part, a series of recessed portions which lie between and are recessed from the substantially flat end surfaces, the series of recessed portions defining a series of gaps which lie between adjacent ones of said projections such that adjacent ones of said substantially flat surfaces are separated from each other by a horizontal distance of between 0.020–0.078 inch, wherein the projections have a sufficient dimension and are stiff enough to prevent a golf ball from contacting a lower portion of the series of recessed portions when the putter head strikes a golf ball during a putting stroke and whereby the projections reduce the amount of surface area of a golf ball in contact with the putter head body.

2. The putter head as in claim 1, wherein the projections are formed from a material having a Young's modulus of at least 95 shore A.

3. The putter head as in claim 2, wherein thee material is a polymeric material.

4. The putter head as in claim 1, wherein the projections are formed from a polymeric material.

* * * * *